US007589265B2

(12) United States Patent
Kenagy et al.

(10) Patent No.: US 7,589,265 B2
(45) Date of Patent: Sep. 15, 2009

(54) UPRIGHT PIANO

(75) Inventors: Susan Yake Kenagy, Dix Hills, NY (US); Sue Guan Lim, Flushing, NY (US)

(73) Assignee: Steinway Musical Instruments, Inc., Waltham, MA (US)

( * ) Notice: Subject to any disclaimer, the term of this patent is extended or adjusted under 35 U.S.C. 154(b) by 56 days.

(21) Appl. No.: 11/968,473

(22) Filed: Jan. 2, 2008

(65) Prior Publication Data

US 2009/0165628 A1 Jul. 2, 2009

(51) Int. Cl.
*G10C 3/02* (2006.01)

(52) U.S. Cl. ..... 84/177; 84/178; 84/179; 84/180; 84/200

(58) Field of Classification Search ..... 84/177–183, 84/200
See application file for complete search history.

(56) References Cited

U.S. PATENT DOCUMENTS 465,506 A * 12/1891 Weser ..... 84/225
637,160 A * 11/1899 Richter ..... 84/177
855,143 A * 5/1907 Steinway ..... 84/182
1,101,367 A * 6/1914 Wilberg ..... 84/180
1,728,815 A * 9/1929 Waddington ..... 84/180
2,110,946 A * 3/1938 Worthington ..... 84/177
2,249,978 A * 7/1941 Pfaff ..... 84/177
2,263,839 A * 11/1941 Farny ..... 84/177
2,505,805 A * 5/1950 Frederick ..... 84/174
2,993,807 A * 7/1961 Abbott, Jr. et al. ..... 428/215
3,248,989 A * 5/1966 Schroth ..... 84/177
3,309,335 A * 3/1967 Walton ..... 523/521
2008/0190261 A1* 8/2008 Kenagy et al. ..... 84/177
2009/0165628 A1* 7/2009 Kenagy et al. ..... 84/177

* cited by examiner

*Primary Examiner*—Jeffrey Donels
*Assistant Examiner*—Robert W Horn
(74) *Attorney, Agent, or Firm*—Fish & Richardson P.C.

(57) ABSTRACT

An upright piano includes a piano case having an upper front panel, a left side panel, a right side panel, and a top lid. The upper front panel is pivotally mounted below and generally abutting the top lid. A keyboard is supported by the piano case and has a plurality of keys. A keyboard lid has a width substantially equal to a width of the upper front panel. The piano includes left and right upper front panel strips disposed on the corresponding left and right side panels. The upper front panel is pivotally attached to the left and right upper front panel strips to rotate between a closed position and an open position. The upper front panel is substantially parallel to and substantially in between the left and right upper front panel strips while in the closed position.

8 Claims, 9 Drawing Sheets

UPRIGHT PIANO

TECHNICAL FIELD

This disclosure relates to upright pianos.

BACKGROUND

A piano is a musical instrument that produces sound by striking steel strings with felt hammers that immediately rebound allowing the string to continue vibrating. These vibrations are transmitted through bridges to a soundboard, which amplifies the vibrations. Upright pianos, also called vertical pianos, are more compact than grand pianos (horizontal pianos) because the frame and strings are placed vertically, extending in both directions (up and down) from the keyboard and hammers.

FIGS. 1-4 illustrate a prior art upright piano 10A including a piano case 20 having an upper front panel assembly 25, two side panels 22, and a top lid 24. The upper front panel assembly 25 includes an upper front panel 30A pivotally mounted in a frame 32. The frame 32 is removably mounted to the two side panels 22. In this configuration, found, e.g., in Steinway "K-52" upright pianos, the entire upper front panel assembly 25 must be removed to gain access into the piano case 20 for tuning the piano 10A. Vertical legs 42 of the frame 40 are aligned with keyboard arms 50 of the piano 10A to provide visual continuity.

FIGS. 5-8 illustrate a prior art upright piano 10B including a piano case 20 having an upper front panel 30B, two side panels 22, and a top lid 24. The upper front panel 30B is removably pivotally mounted directly to the two side panels 22. In this configuration, found, e.g., in the Steinway "1098" upright piano, the entire upper front panel 22 is removed to gain access into the piano case 20 for tuning the piano 10B. The upper front panel 30B defines grooves 33 that provide visual continuity with one or more components of the piano 10B.

SUMMARY

In one aspect, an upright piano includes a piano case having an upper front panel, a left side panel, a right side panel, and a top lid. The upper front panel is pivotally mounted below and generally abutting the top lid. A keyboard is supported by the piano case. The keyboard has left and right keyboard arms and a plurality of keys. A keyboard lid is operable to pivot between a closed position covering the keys and an open position providing access to the keys. The keyboard lid has a width substantially equal to a width of the upper front panel, so as to provide visual continuity along their outer edges. The piano includes left and right upper front panel strips fixedly mounted to the corresponding left and right side panels above and substantially parallel to the corresponding left and right keyboard arms. The upper front panel is removably and pivotally supported by the left and right upper front panel strips to rotate between a closed position and an open position. The upper front panel is generally parallel to and substantially between the left and right upper front panel strips while in the closed position. The upper front panel is operable to rest against the key lid while the key lid and the upper front panel are each in their respective open positions.

Implementations of the disclosure may include one or more of the following features. In some implementations, the upper front panel defines a smooth uninterrupted front surface and may have a polyester finish. In some examples, the left upper front panel strip has a surface substantially co-planar with a corresponding surface of the left keyboard arm, and the right upper front panel strip has a surface substantially co-planar with a corresponding surface of the right keyboard arm. The left and right upper front panel strips may have substantially the same width as the corresponding left and right keyboard arms. The left and right upper front panel strips may be positioned to provide visual vertical continuity between the upper front panel strips and the keyboard arms, such that the left and right upper front panel strips and the keyboard arms appear contiguous from a front view.

In some implementations, the left and right upper front panel strips engage on inwardly facing sides and/or front facing sides of the respective left and right side panels. Each upper front panel strip and its associated side panel together may define a substantially L-shaped configuration in top view.

In some implementations, an upper portion of the upper front panel is pivotally attached to the left and right upper front panel strips, allowing a lower portion of the upper front panel to swing freely. The key lid may include a music sheet rest configured to support a music sheet resting against the upper front panel while the key lid and the upper front panel are each in their respective open positions The upright piano may include a panel stop disposed on at least one of the left and right upper front panel strips. The upper front panel stop is configured to prevent rotation of the upper front panel past the closed position into an interior area of the piano case. In some examples, the upper front panel is removably attached to the upper front panel strips. For instance, left and right pivot pegs may be inserted in or disposed on the corresponding left and right upper front panel strips. Left and right clips configured to engage the pivot pegs are disposed on the upper front panel. The upper front panel is releasably clipped onto the pivot pegs and allowed to swing between its open and closed positions.

The details of one or more implementations of the disclosure are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

Figure 1:
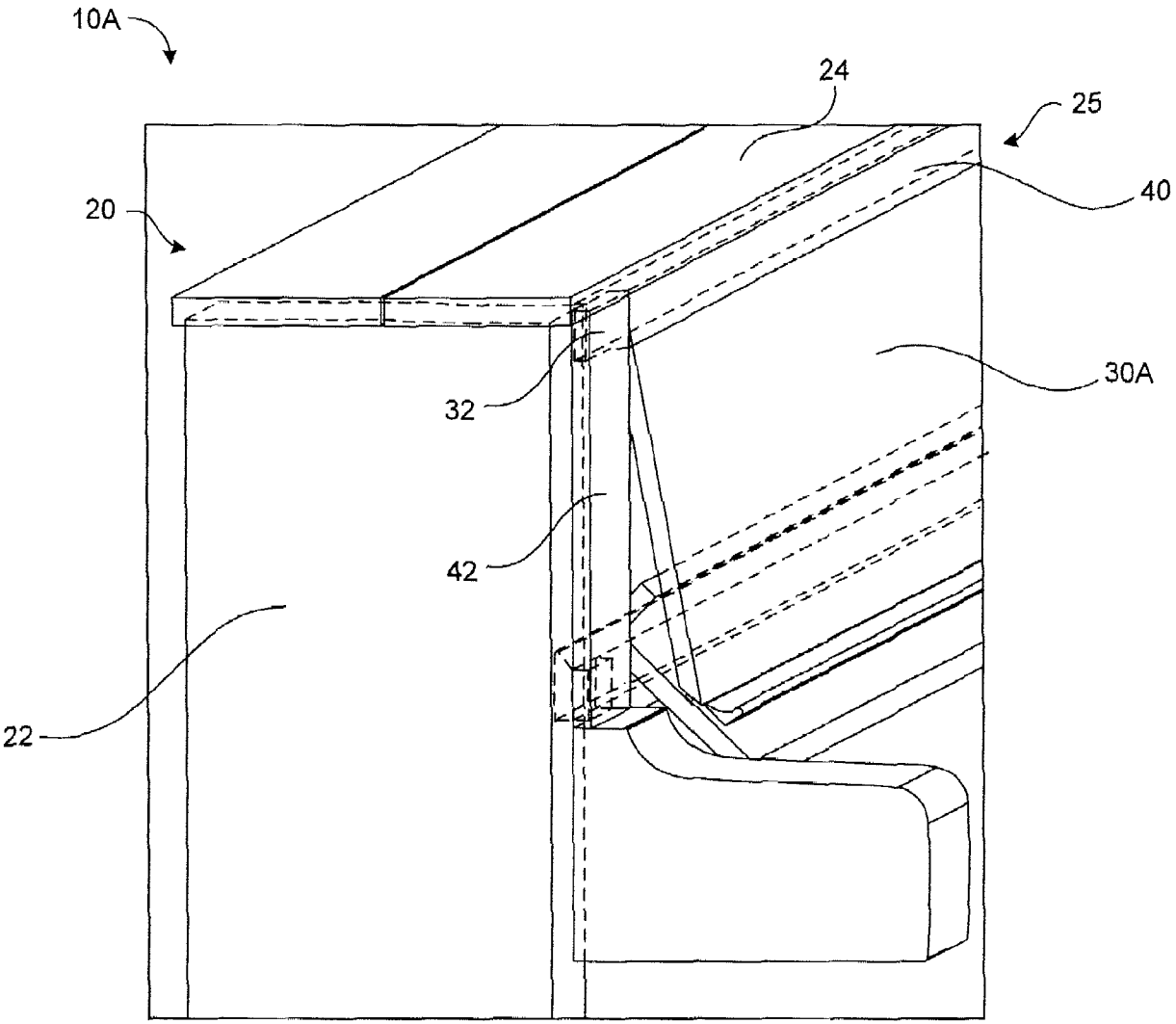
FIG. 1 PRIOR ART
FIG. 1 is a partial perspective view of a prior art upright piano.
Figure 2:
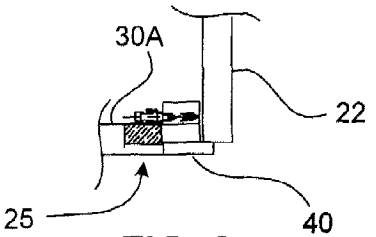
FIG. 2 PRIOR ART
FIG. 2 is a partial top view of a piano case of the prior art upright piano of FIG. 1.
Figure 4:
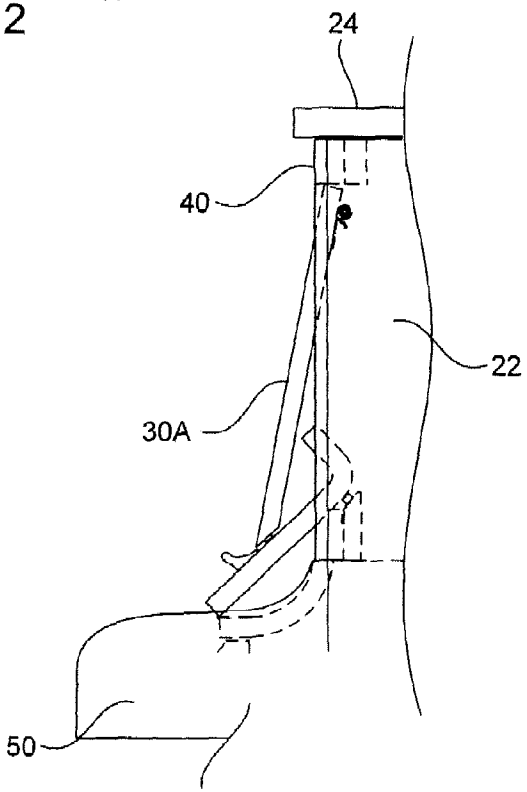
FIG. 4 PRIOR ART
FIG. 4 is a partial side view of the prior art upright piano of FIG. 1.
Figure 3:
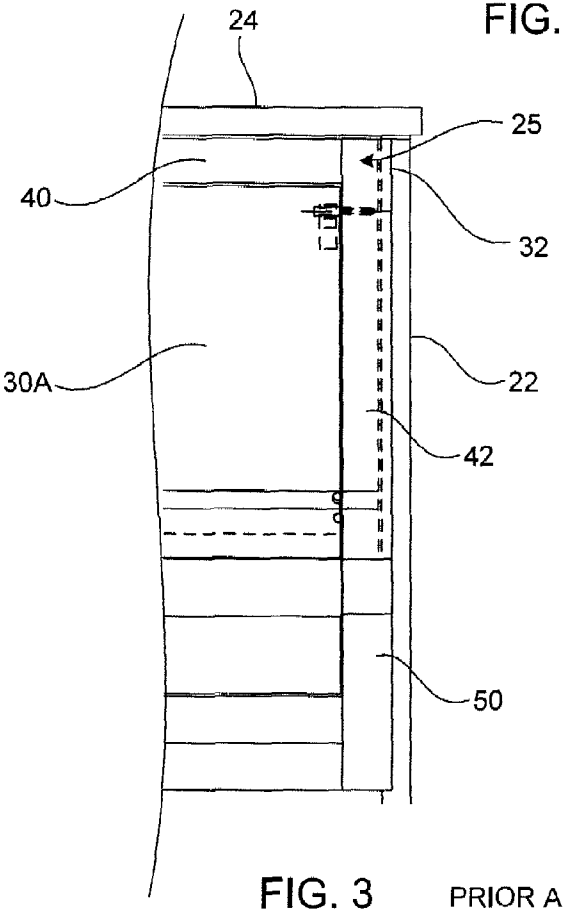
FIG. 3 PRIOR ART
FIG. 3 is a partial front view of the prior art upright piano of FIG. 1.
Figure 5:
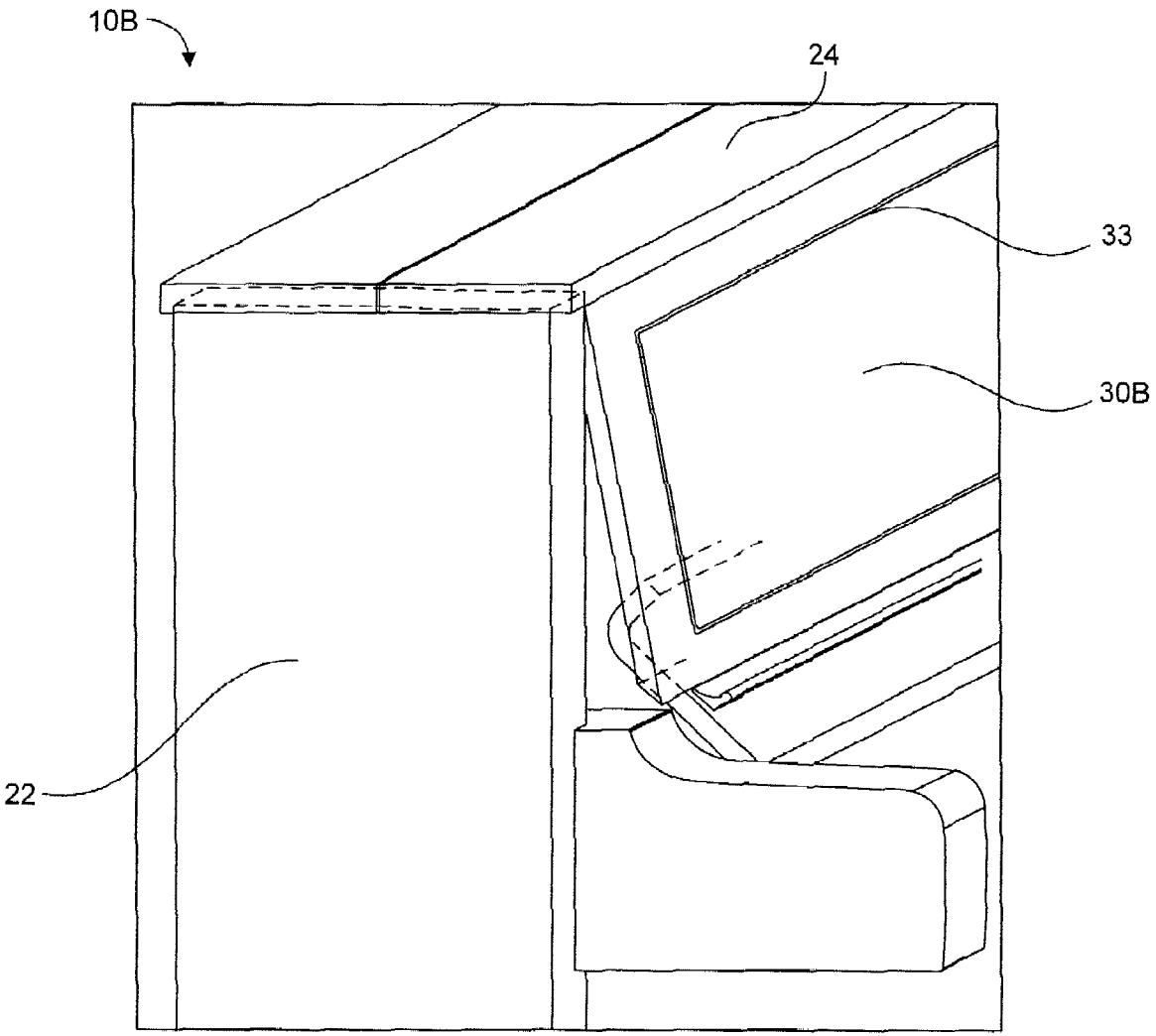
FIG. 5 PRIOR ART
FIG. 5 is a partial perspective view of another prior art upright piano.
Figure 6:
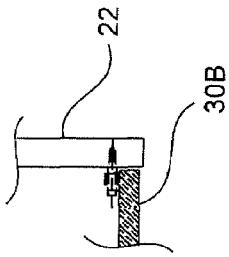
PRIOR ART FIG. 6
FIG. 6 is a partial top view of a piano case of the prior art upright piano of FIG. 5.
Figure 8:
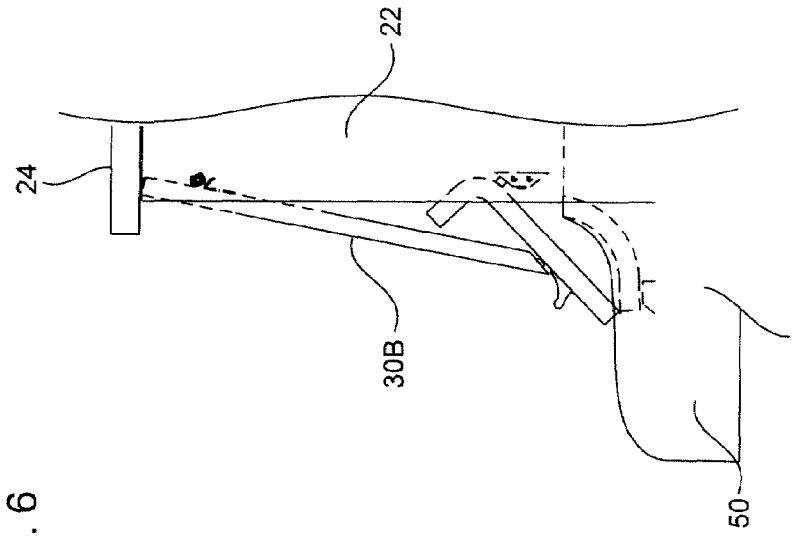
PRIOR ART FIG. 8
FIG. 8 is a partial side view of the prior art upright piano of FIG. 5.
Figure 7:
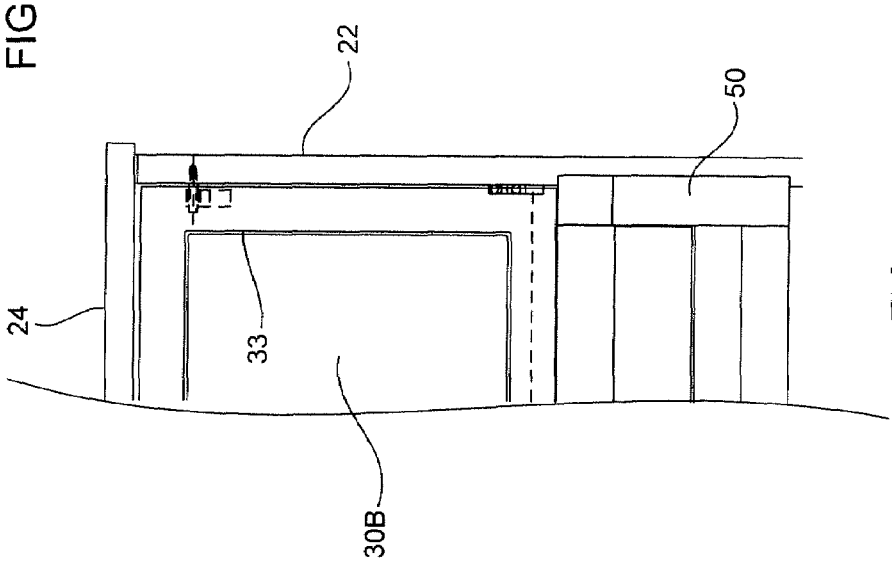
PRIOR ART FIG. 7
FIG. 7 is a partial front view of the prior art upright piano of FIG. 5.
Figure 9:
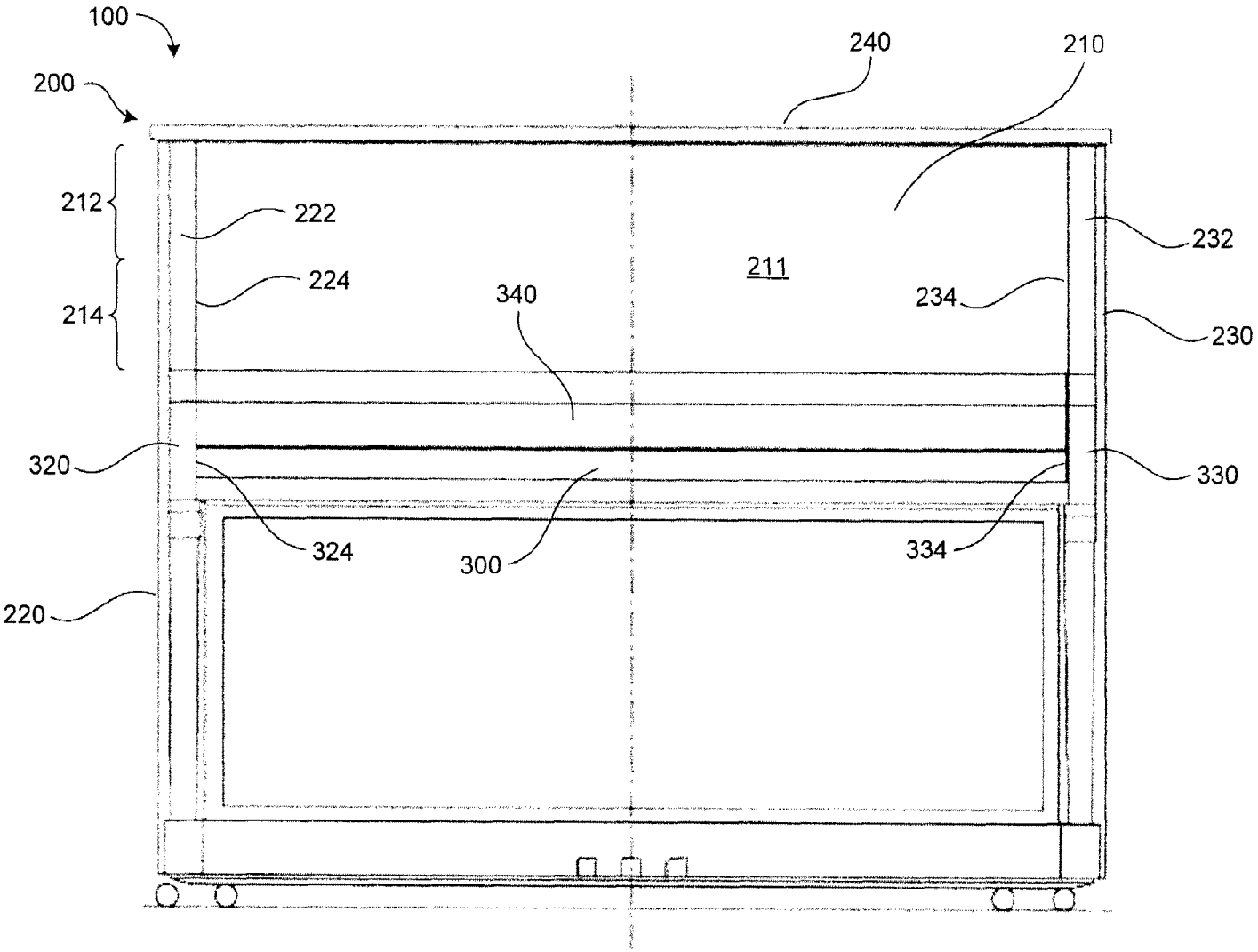
FIG. 9 is a front view of an upright piano.
Figure 10:
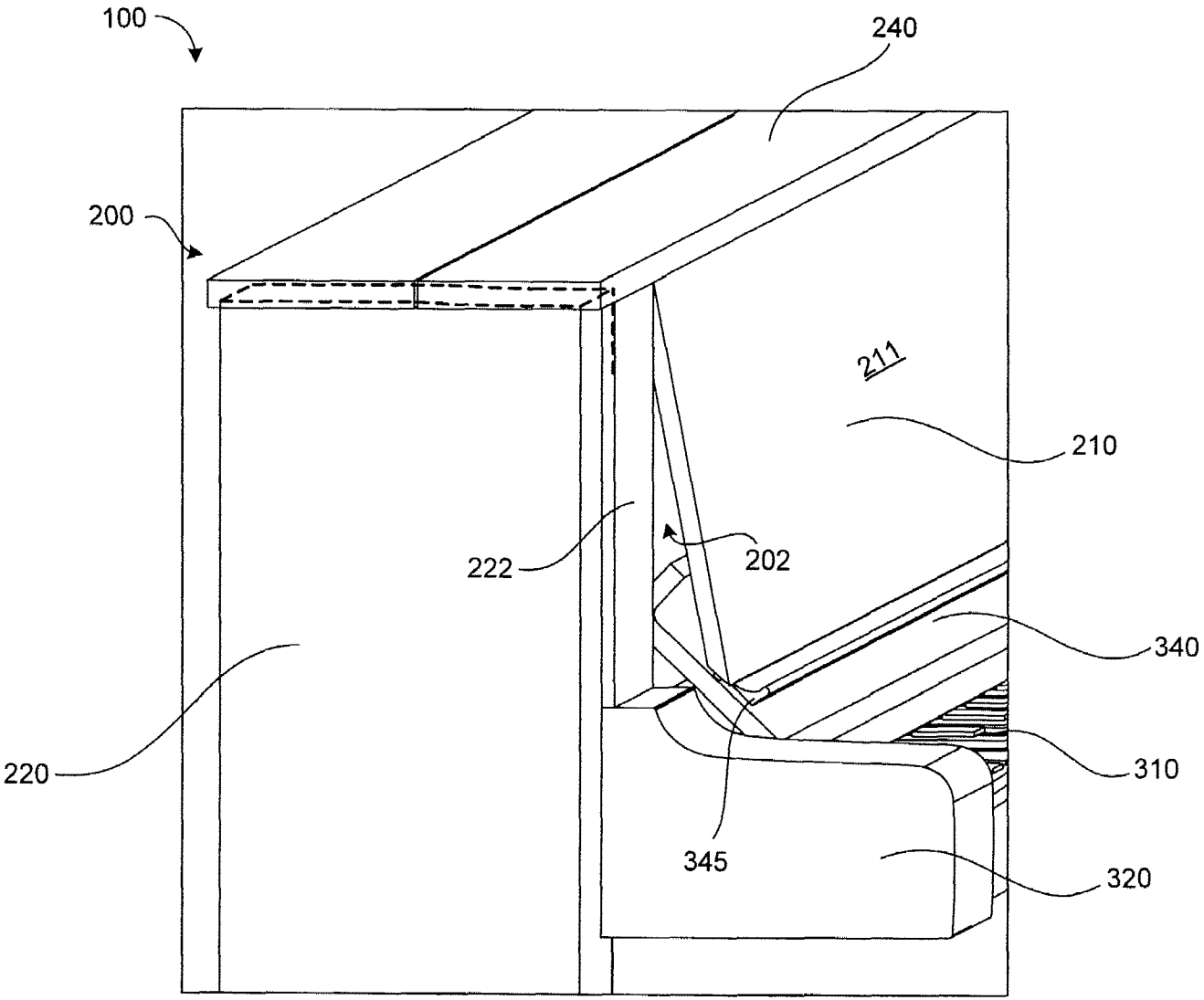
FIG. 10 is a partial perspective view of the upright piano of FIG. 9.

Referring to FIGS. 9-10, an upright piano 100 includes a piano case 200 having an upper front panel 210, a left side panel 220, a right side panel 230, and a top lid 240. The upper front panel 210 is pivotally mounted below and generally abutting the top lid 240. A keyboard 300 is supported by the piano case 200 and has a plurality of keys 310. The upright piano 100 includes left and right upper front panel strips 222 and 232, respectively, disposed on the corresponding left and right side panels 220 and 230. The upper front panel strips 222 and 232 may be formed integral with the side panels 220 and 230 or affixed to the side panels 220 and 230 (e.g. by adhesive or fasteners 85 (see FIG. 11)). The upper front panel strips 222 and 232 may be configured to provide increased rigidity of the piano case 200. The upper front panel 210 is pivotally attached to the left and right upper front panel strips 222 and 232 to rotate between a closed position and an open position. The upper front panel 210 is generally parallel to and substantially between the left and right upper front panel strips 222 and 232 while in the closed position.

In some implementations, an upper portion 212 of the upper front panel 210 is pivotally attached to the left and right upper front panel strips 222 and 232, thereby allowing a lower portion 214 of the upper front panel 210 to swing freely. The upper front panel 210 may have a polyester finish, which may not be amenable to routed grooves or edges. In some examples, the upper front panel 210 has a contiguous uninterrupted front surface 211 (e.g. free of grooves or recessions).

In the example illustrated, the upright piano includes left and right keyboard arms 320 and 330, respectively, supporting the keyboard 300 therebetween. The left and right upper front panel strips 222 and 232 are disposed above and substantially parallel to the corresponding left and right keyboard arms 320 and 330. In some examples, the left upper front panel strip 222 has a surface 224 substantially co-planar with a corresponding surface 324 of the left keyboard arm 320 (e.g. to provide visual continuity). Similarly, the right upper front panel strip 232 has a surface 234 substantially co-planar with a corresponding surface 334 of the right keyboard arm 330. In some examples, the left and right upper front panel strips 222 and 232 have substantially the same width as the corresponding left and right keyboard arms 320 and 330 (e.g. to provide visual continuity).

In some implementations, as shown in FIG. 10, the upright piano 100 includes a key lid 340 operable to pivot between a closed position covering the keys 310 and an open position providing access to the keys 310. The key lid 340 is configured to support the upper front panel 210 while the key lid 340 and the upper front panel 210 are each in their respective open positions. The key lid 340 in the example shown includes a music sheet rest 345 configured to support a music sheet (not shown) resting against the upper front panel 210 while the key lid 340 and the upper front panel 210 are each in their respective open positions. The music sheet rest 345 may be a rib or ridge extending along the key lid 340, as shown. In some instances, the music sheet rest 345 is configured to fold down into the key lid 340. In some examples, the upper front panel 210 has a width substantially equal to a width of the key lid 340 (e.g. to provide visual continuity).

Figure 11:
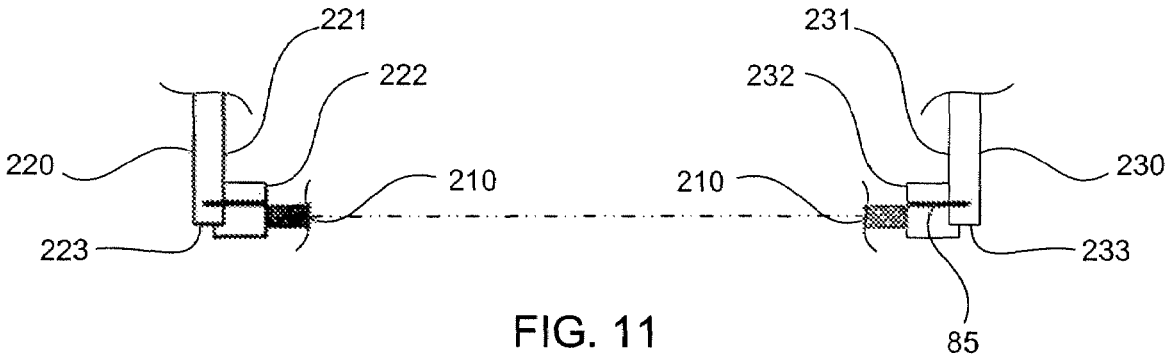
FIG. 11 is a partial top view of a piano case of the upright piano of FIG. 9.

Referring to FIG. 11, in some examples, the left and right upper front panel strips 222 and 232 are disposed on inwardly facing sides 221 and 231 and/or front facing sides 223 and 233 of the respective left and right side panels 220 and 230. In the example shown, the left and right upper front panel strips 222 and 232 are disposed on both the inwardly facing sides 221 and 231 and the front facing sides 223 and 233 of the respective left and right side panels 220 and 230. In preferred examples, each upper front panel strip 222 and 232 and its associated side panel 220 and 230 together define a substantially L-shaped configuration in top view, as shown.

Figure 12:
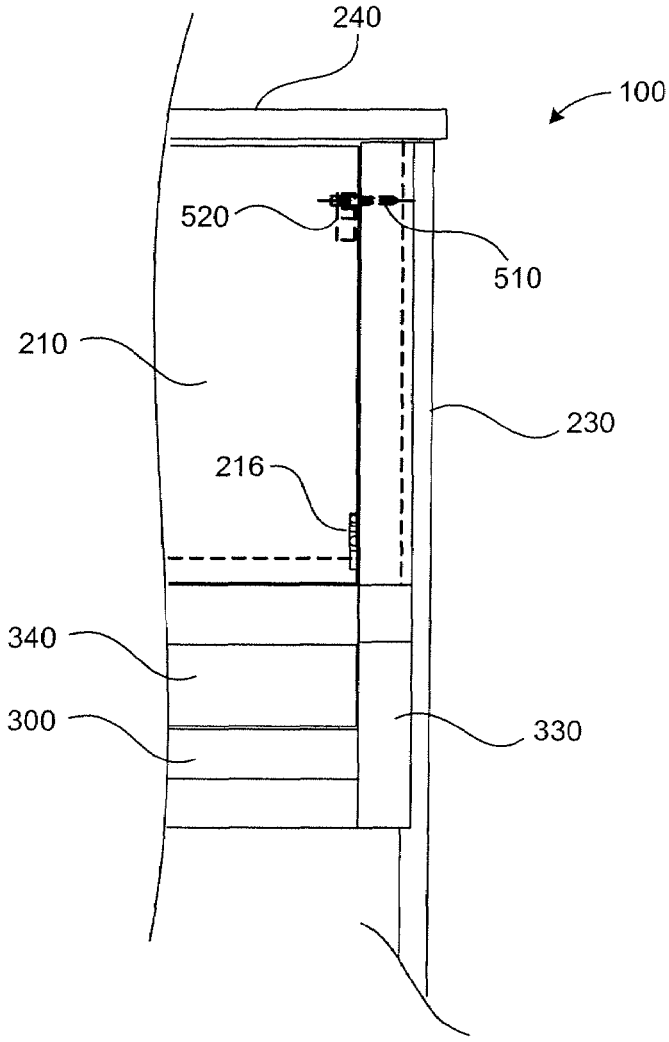
FIG. 12 is a partial front view of the upright piano of FIG. 9.
Figure 13:
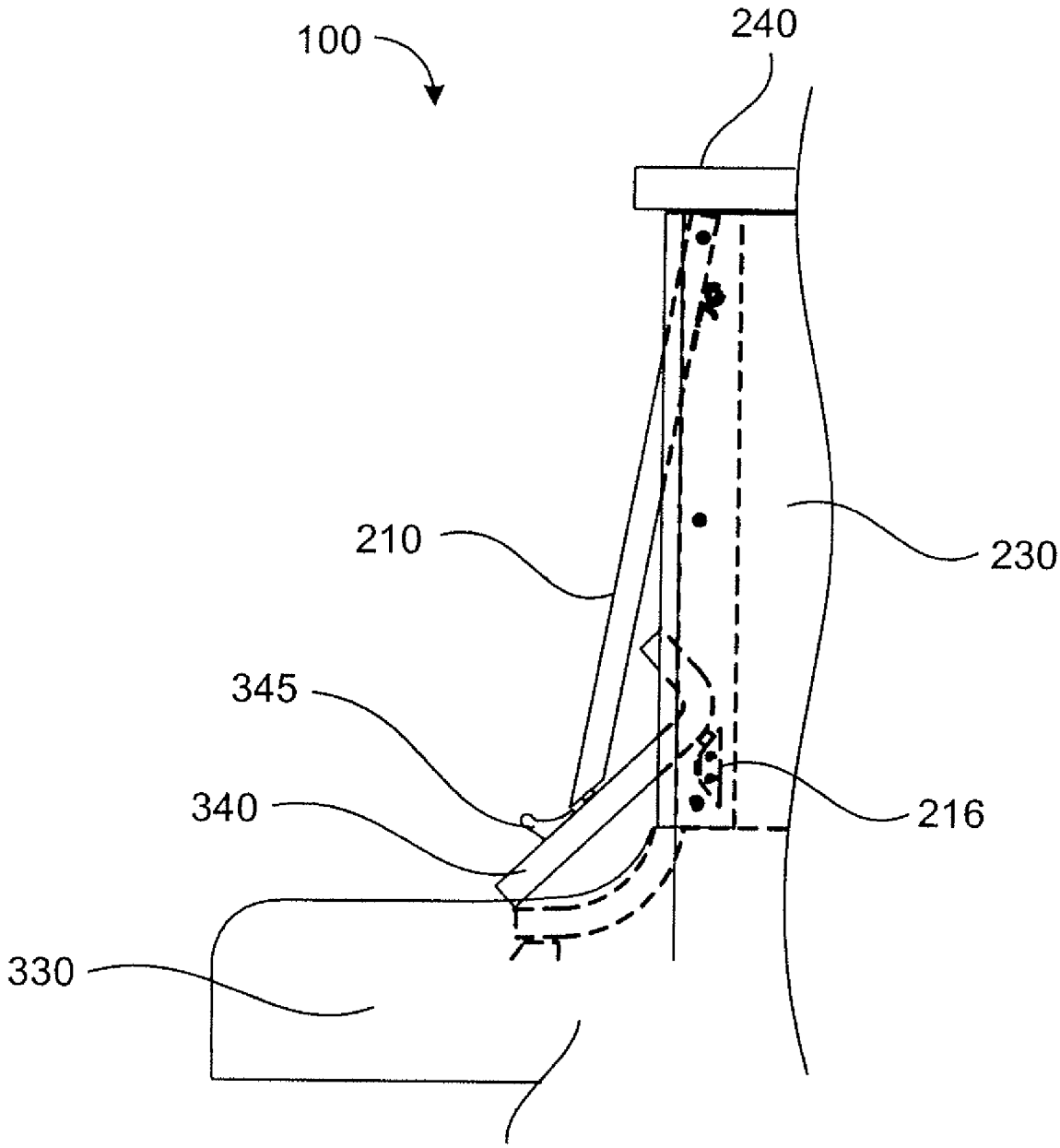
FIG. 13 is a partial side view of the upright piano of FIG. 9 with an upper front panel and a keyboard lid in their open positions.
Figure 14:
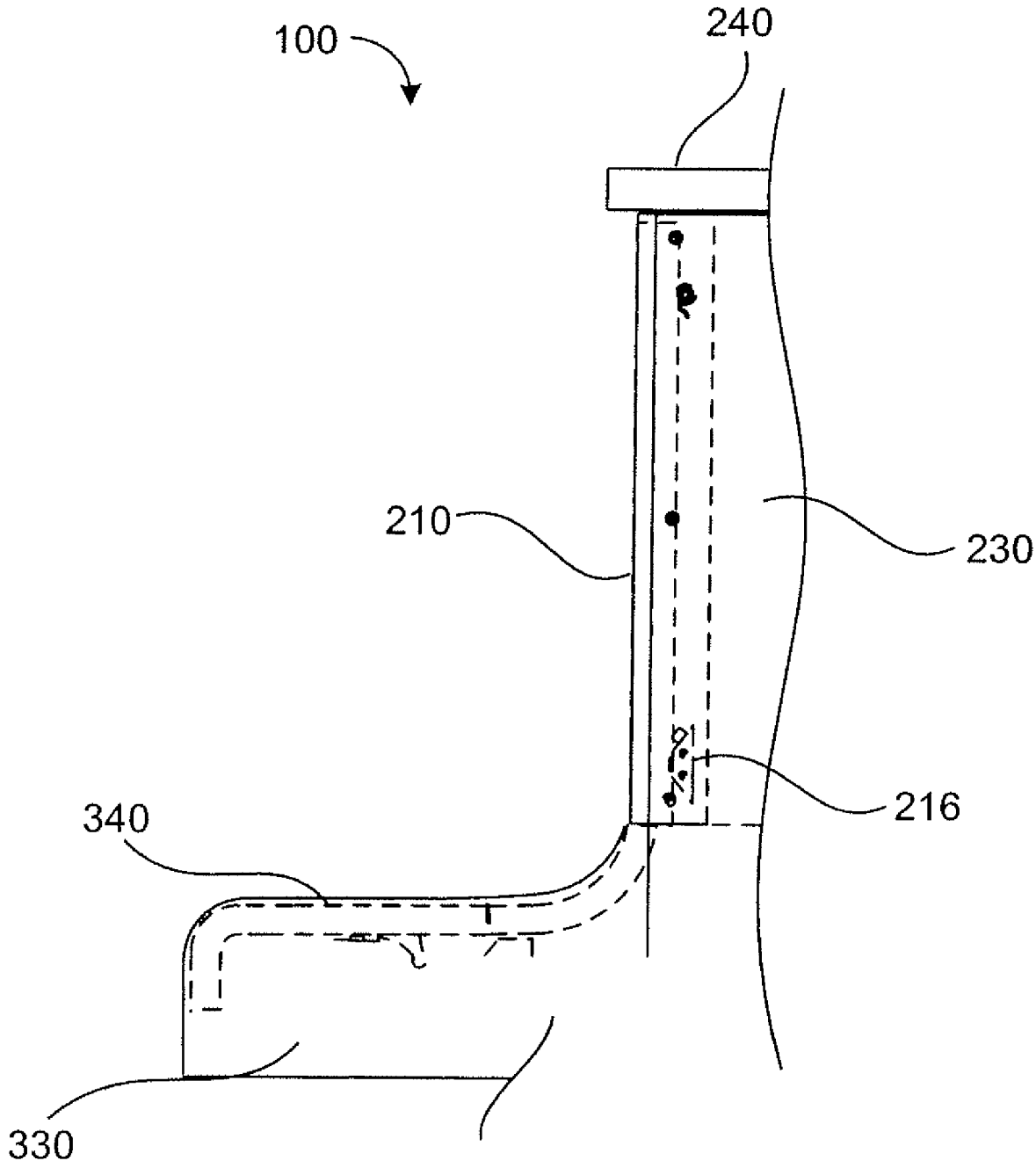
FIG. 14 is a partial side view of the upright piano of FIG. 9 with an upper front panel and a keyboard lid in their closed positions.

In the example illustrated in FIGS. 12-13, the upright piano 100 includes a upper front panel stop 216 disposed on at least one of the left and right upper front panel strips 222 and 232. The upper front panel stop 216 is configured to prevent rotation of the upper front panel 210 past the closed position into an interior area 202 (see e.g. FIG. 10) of the piano case 200. The upper front panel stop 216 may also be configured to support the key lid 340 in the open position, and prevent the key lid 340 from rotating past the open position into or further into the interior area 202 of the piano case 200. FIG. 13 provides a partial side view of the upright piano 100 with the upper front panel 210 and the keyboard lid 340 in their open positions. To hold the upper front panel 210 in its open position, the upper front panel 210 is pulled open, the key lid 340 is then rotated to its open position (e.g. resting against the upper front panel stop 216), and the upper front panel 210 is lowered onto the key lid 340, which supports the upper front panel 210 in its open position. In this configuration, the upper front panel 210 and the key lid 340 are arranged to support sheet music, music books, and other objects (e.g. against the upper front panel 210 and on the music sheet rest 345) for viewing by a piano player. The steps are repeated in reverse to move the upper front panel 210 and the key lid 340 back to their closed positions. FIG. 14 provides a partial side view of the upright piano 100 with the upper front panel 210 and the keyboard lid 340 in their closed positions.

Referring again to FIG. 12, in some implementations, the upper front panel 210 is removably attached to the upper front panel strips 222 and 232. In the example shown, a pivot peg 510 is disposed on each of the upper front panel strips 222 and 232. Clips 520 are disposed on the upper front panel 210 and configured to reasonably engage the corresponding pivot pegs 510 on the upper front panel strips 222 and 232. While hung on the pivot pegs 510, the upper front panel 210 is free to swing between its open and closed positions. For tuning the piano 100, the upper front panel 210 is unclipped from the pivot pegs 510 and removed from the piano case 200, thereby allowing access to the interior area 202 of the piano 100.

Removal of a single panel (e.g. the upper front panel 210) for tuning may be less cumbersome than removing a upper front panel assembly including a upper front panel pivotally attached to a frame. As a result, one or more of the disclosed implementations advantageously provide a removable upper front panel for access inside the piano. The disclosed piano configurations also provide visual continuity between the upper front panel strips 222 and 232 and the keyboard arms 320 and 330, as well as between the upper front panel 210 and the key lid 340 and/or the keyboard 300.

A number of implementations have been described. Nevertheless, it will be understood that various modifications may be made without departing from the spirit and scope of the disclosure. Accordingly, other implementations are within the scope of the following claims.

What is claimed is:

1. An upright piano comprising:

a piano case having an upper front panel, a left side panel, a right side panel, and a top lid, the upper front panel being pivotally mounted below and generally abutting the top lid;

a keyboard supported by the piano case, the keyboard having left and right keyboard arms and a plurality of keys;

a keyboard lid operable to pivot between a closed position covering the keys and an open position providing access to the keys, the keyboard lid having a width substantially equal to a width of the upper front panel; and left and right upper front panel strips fixedly mounted to the corresponding left and right side panels above and substantially parallel to the corresponding left and right keyboard arms;

wherein the upper front panel is removably and pivotally supported by the left and right upper front panel strips to rotate between a closed position and an open position, the upper front panel being generally parallel to and substantially between the left and right upper front panel strips while in the closed position, the upper front panel operable to rest against the key lid while the key lid and the upper front panel are each in their respective open positions.

2. The upright piano of claim 1, wherein the upper front panel defines a smooth uninterrupted front surface.

3. The upright piano of claim 2, wherein the upper front panel comprises a polyester finish.

4. The upright piano of claim 3, wherein the left upper front panel strip has a surface substantially co-planar with a corresponding surface of the left keyboard arm, and the right upper front panel strip has a surface substantially co-planar with a corresponding surface of the right keyboard arm.

5. The upright piano of claim 4, wherein the left and right upper front panel strips have substantially the same width as the corresponding left and right keyboard arms.

6. The upright piano of claim 1, wherein the left and right upper front panel strips engage on inwardly facing sides of the respective left and right side panels.

7. The upright piano of claim 1, wherein the left and right upper front panel strips engage on front facing sides of the respective left and right side panels.

8. The upright piano of claim 1, wherein each upper front panel strip and its associated side panel together define a substantially L-shaped configuration in top view.

* * * * *